US005350531A

United States Patent [19]

Musilli

[11] Patent Number: 5,350,531

[45] Date of Patent: Sep. 27, 1994

[54] PROCESS FOR PREPARING A GREASE COMPOSITION

[75] Inventor: Thomas G. Musilli, Akron, N.Y.

[73] Assignee: Frey, the Wheelman, Inc., Buffalo, N.Y.

[21] Appl. No.: 127,623

[22] Filed: Sep. 27, 1993

Related U.S. Application Data

[63] Continuation-in-part of Ser. No. 922,157, Jul. 30, 1992, abandoned.

[51] Int. Cl.[5] ..... C10M 117/02

[52] U.S. Cl. ..... 252/41; 252/18

[58] Field of Search ..... 252/18, 40, 41

[56] References Cited

U.S. PATENT DOCUMENTS

| | | | |
|---|---|---|---|
| 2,813,829 | 11/1957 | Woods et al. | 252/40 |
| 2,929,781 | 3/1960 | Beerbower et al. | 252/40 |
| 2,967,826 | 1/1961 | Dilworth et al. | 252/40 |
| 3,891,564 | 6/1975 | Carley et al. | 252/40 |
| 4,052,322 | 10/1977 | Crookshank | 252/40 |
| 4,435,299 | 3/1984 | Carley et al. | 252/41 |
| 4,597,881 | 7/1986 | Iseya et al. | 252/41 |

*Primary Examiner*—Jacqueline V. Howard

*Attorney, Agent, or Firm*—Howard J. Greenwald; James F. Mudd

[57] ABSTRACT

A process for preparing a lubricating grease in which a bright stock paraffin oil is mixed with 12-hydroxy stearic acid, and the mixture is then heated to a temperature of from about 170 to about 200 degrees Fahrenheit for at least 30 minutes. Thereafter, lithium hydroxide and calcium hydroxide are added to the mixture, and the mixture is then neutralized by heating it to a temperature of from about 360 to about 450 degrees Fahrenheit. The saponified mixture is then comminuted so that at least about 90 weight percent of the particles in it are smaller than 1 micron. To this comminuted mixture is then added another portion of the specified paraffinic bright stock oil.

10 Claims, 1 Drawing Sheet

PROCESS FOR PREPARING A GREASE COMPOSITION

CROSS-REFERENCE TO RELATED PATENT APPLICATION

This is a continuation-in-part of applicant's copending patent application U.S. Ser. No. 07/922,157, filed on Jul. 30, 1992. Now abandoned

FIELD OF THE INVENTION

A process for preparing a grease composition which contains twelve-hydroxy calcium stearate is disclosed.

BACKGROUND OF THE INVENTION

Greases containing twelve-hydroxy calcium stearate, and processes for their preparation, are well known to those skilled in the art.

In 1953, in their U.S. Pat. No. 2,822,331, John P. Dilworth et al. disclosed (at column 1) that prior art ". . . attempts to make a substantially anhydrous calcium 12-hydroxy grease by conventional grease making procedures have proved unsatisfactory due to the fact that the resulting product is so grainy and has such poor stability as to be unsalable". This patent disclosed a composition containing minor amounts of the estolide polyesters of 12-hydroxy stearic acid.

In 1966, the problems with the manufacture of calcium hydroxy stearate greases were again discussed. In their U.S. Pat. No. 3,242,083, Crookshank et al. disclosed (at column 1) that "Calcium hydroxy fatty acid soap thickened greases are very difficult to prepare in satisfactory smooth form by the low temperature process of the prior art, due to the tendency of these greases to form lumpy or grainy products. Very close control of the operating conditions is therefore required in the preparation of these greases. In addition, the low temperature methods of the prior art have the serious economic disadvantage of requiring very long manufacturing times".

In 1958, in their U.S. Pat. No. 2,841,556, Reuben A. Swenson et al. disclosed (at column 1) that ". . . the prior art method of preparing calcium soap greases with 12-hydroxy stearic acid requires slow, careful dehydration at temperatures below about 275 F. over a relatively long period of time. One method of preparing such . . . greases . . . requires about 14 hours for dehydration".

These prior art 12-hydroxy calcium stearate greases, although satisfactory for certain purposes, often exhibited poor oxidation resistance, and/or poor compatibility with elastomeric materials.

It is an object of this invention to provide a process for preparing a 12-hydroxy calcium stearate grease with improved oxidation resistance.

It is another object of this invention to provide a process for preparing a 12-hydroxy calcium stearate grease with improved compatibility with elastomeric materials.

It is yet another object of this invention to provide a process for preparing a 12-hydroxy calcium stearate grease with improved uniformity.

It is yet another object of this invention to provide a process for the preparation of a 12-hydroxy calcium stearate grease which requires less energy than comparable prior art processes.

It is yet another object of this invention to provide a process for the preparation of a 12-hydroxy calcium stearate grease with a substantially higher yield of the desired product.

It is yet another object of this invention to provide a process for the preparation of a 12-hydroxy calcium stearate grease which produces a product with improved stability when subjected to shear.

SUMMARY OF THE INVENTION

In accordance with this invention, there is provided a process for preparing a 12-hydroxy calcium lithium stearate grease. In the first step of the process, 12-hydroxy stearic acid is mixed with a first portion of a paraffin bright stock oil and thereafter heated to a temperature of from about 170 to about 200 degrees Fahrenheit. Thereafter, lithium hydroxide and calcium hydroxide are added to the mixture, the mixture is then heated to a temperature of from about 360 to about 450 degrees Fahrenheit and saponified, and then the product is comminuted. The comminuted mixture is then mixed with a second portion of lubricating oil.

BRIEF DESCRIPTION OF THE DRAWINGS

The process of this invention will be described by reference to the following drawings, wherein like reference numerals refer to like elements, and wherein.

DESCRIPTION OF THE PREFERRED EMBODIMENT

Figure 1:
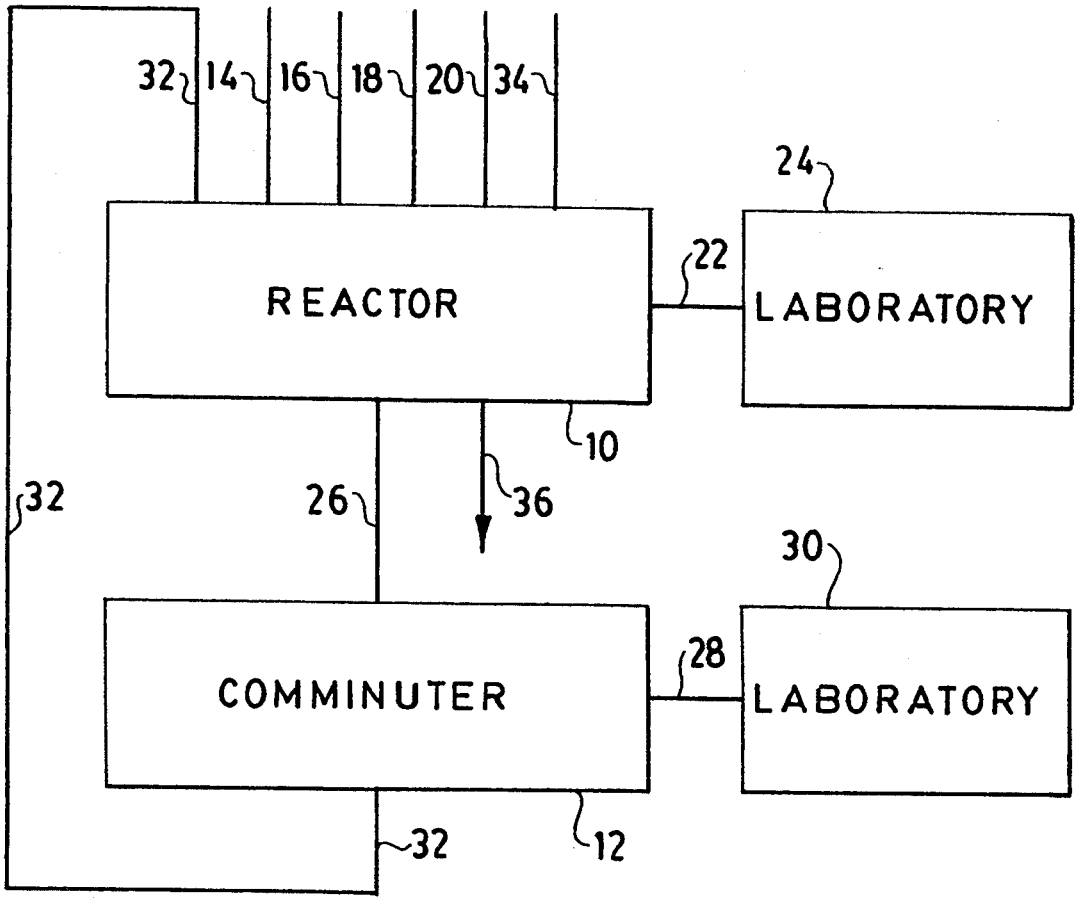
FIG. 1 is a flow chart of the preferred process of this invention.

FIG. 1 is a flow diagram illustrating one preferred process of this invention. In such process, one utilizes a reactor 10 and a comminuter 12.

In the first step of the process, 12-hydroxy stearic acid and a specified lubricating oil are charged to reactor 12 via lines 14 and 16, respectively.

One may use any of the 12-hydroxy stearic acids which are commercially available. This acid is well known and is described, e.g., in U.S. Pat. No. 2,841,556 of Swenson, the disclosure of which is hereby incorporated by reference into this specification. Thus, for example, one may obtain such a 12-hydroxy stearic acid as reagent number 21,996-7 from the 1992–1993 Aldrich Catalog (Aldrich Chemical Company, 1001 West Saint Paul Avenue, Milwaukee, Wis.).

In one embodiment, it is preferred that the hydroxystearic acid used in the process have a neutralization value of from about 170 to about 200 and a saponification number of from about 180 to about 220.

The lubricating oil which is charged to reactor 12 via line 16 is a paraffinic oil. As is known to those skilled in the art, a paraffinic oil is a lubricating oil which is either pressed or dry-distilled from paraffin distillate. Thus, by way of illustration, liquid petrolatum is a paraffin oil.

In one preferred embodiment, the paraffin oil is referred to and known as a "paraffinic bright stock" oil. As is known to those skilled in the art, a paraffinic oil contains substantially no free acidity or free alkalinity. With such an oil, if one were to titrate the oil with acid, there would be substantially no free base in it to react with the acid. Conversely, if one were to react such an oil with a base, there would be substantially no free acid to react with the base.

The lubricating oil used in the process of this invention preferably is neutral. One may use conventional means to determine whether a particular paraffinic oil is neutral. Thus, for example, one may use the procedure described in A.S.T.M. Standard Test D 3339-87, "Test Method for Total. Acid Numbers by Semi-Micro Color Indicator Titration".

In one embodiment, the paraffin oil used in the process preferably has an aniline point of at least about 220 degrees Fahrenheit; it is preferred that the paraffin oil have an aniline point of at least about 245 degrees Fahrenheit. As is known to those skilled in the art, the aniline point of an oil is the minimum temperature for complete miscibility of equal volume of aniline and the oil. The aniline point may be determined in accordance with A.S.T.M. Standard Test D 611-82(1987), "Test Method for Aniline Point and Mixed Aniline Point of Petroleum Products and Hydrocarbon Products".

In one embodiment, the paraffin oil used in the process preferably has a viscosity index of at least 90 and, preferably, be from about 90 to about 100. As is known to those skilled in the art, the viscosity index indicates the effect of a change of temperature on the kinematic viscosity of an oil; a high viscosity index indicates a relatively small change of kinematic viscosity with temperature. The viscosity index of an oil may be determined by conventional means such as, e.g., A.S.T.M. Standard Test D 2270-86, "Method for Calculating Viscosity Index from Kinematic Viscosity at 40 and 100 degrees Centigrade".

The paraffin oil used in the process preferably has a Saybolt viscosity, at 100 degrees Fahrenheit, of from about 100 to about 3000. As is known to those skilled in the art, the Saybolt Universal viscosity is the efflux time in "Saybolt Universal seconds" (SUS) of 60 milliliters of sample flowing through a calibrated Universal orifice in a Saybolt viscometer under specified conditions. The Saybolt viscosity may be determined by conventional means such as, e.g., by A.S.T.M. Standard Test D 88-81(1987), "Test Method for Say-bolt Viscosity".

In one preferred embodiment the Saybolt viscosity of the lubricating oil is from about 1,500 to about 3,000 SUS. In this embodiment, it is even more preferred that the Saybolt viscosity of the lubricating oil be from about 1700 to about 2300 SUS.

It is preferred that the lubricating oil used in the process of this invention have a flash point of at least about 550 degrees Fahrenheit. As is known to those skilled in the art, the flash point of a lubricating oil may be measured by A.S.T.M. Standard Test D92-85, "Test Method for Flash and Fire Points by Cleveland Open Cup".

The lubricating oil used in the process of this invention has a pour point of from about 10 to about 35, and preferably of from about 15 to about 25, as measured by A.S.T.M. Standard Test D97-87, "Test Methods for Pour Points of Petroleum Oils". As is known to those skilled in the art, the pour point of an oil is the lowest temperature at which the oil is observed to flow when cooled and examined under prescribed conditions.

As is known to those skilled in the art, the paraffinic bright stock lubricating oils are readily commercially available. Thus, by way of illustration and not limitation, and referring to a publication D239-E2 published in 1991 by Exxon Corporation of Houston, Tex. and entitled "Products for Compounder-Blenders", one may use product number 2507 which is identified as a "150 Sol. Ext. Bright Stock" (formula number 2507), which has a Saybolt viscosity at 100 degrees Fahrenheit of 2400 SUS, has a flash point of 575 degrees Fahrenheit, has a pour point of 15 degrees Fahrenheit, and has an aniline point of 261 degrees Fahrenheit. By way of further illustration, one may use "HF bright stock" which is sold by the Penzoil Company of Houston, Texas and which has a Saybolt viscosity at 100 degrees Fahrenheit of 2650 SUS, a flash point of 565 degrees Fahrenheit, an aniline point of 245 degrees Fahrenheit, and a pour point of 15 degrees Fahrenheit.

The stearic acid and the paraffinic oil are charged to reactor 10. Reactor 10 may be any of the reactors commonly used to make grease, many of which are disclosed on pages 2.01 to 2.08 of the "NLGI Lubricating Grease Guide" (National Lubricating Grease Institute, 4635 Wyandotte Street, Kansas City, Mo., 1989).

Thus, by way of illustration, and as disclosed on pages 2.01 to 2.03 of the Lubricating Grease Guide, one may use a grease kettle. Heating of such a kettle may be done on an open fire, in which case cooling is usually accompanied with cold oil, which is part of the formula. One may use a jacketed kettle, which is a double-walled vessel with space for a heat transfer medium in the space between the walls. Mixing in grease kettles is generally horizontal. To improve and speed mixing, the contents of the kettle may be pumped out of the bottom of the kettle and returned to the top of the kettle.

Alternatively, or additionally, reactor 10 may be a closed vessel, such as the contactor discussed on pages 2.05 through 2.07 of the Lubricating Grease Guide. Such a contactor is a jacketed pressure vessel of generally conical shape in which contents are driven by a high speed impeller.

Referring again to FIG. 1, the 12-hydroxy stearic acid is charged to reactor 10. It is preferred to charge all of the stearic acid at one time; and it is preferred to charge the paraffinic oil at least two different times.

In general, the amount of stearic acid and paraffinic oil charged to reactor 10 is such that from about 25 to about 35 parts of 12-hydroxy stearic acid (by combined weight of stearic acid and paraffinic oil) and from about 75 to about 65 parts of paraffinic oil (by combined weight of stearic acid and paraffinic oil) are charged to reactor 10. In one embodiment, from about 28 to about 33 parts of 12-hydroxy stearic acid and from about 72 to about 67 parts of paraffinic oil are used. In another embodiment, 30 parts of 12-hydroxy stearic acid and 70 parts of paraffinic oil are used.

Based upon the final composition desired, one first can calculate the amount of the paraffinic oil and the 12-hydroxy stearic acid desired to be used. Thereafter, all of the 12-hydroxy stearic acid to be used in the process and a minor amount of the paraffinic oil to be used is initially charged to reactor 10. By way of illustration and not limitation, where a 10,000 pound charge of 12-hydroxy stearic acid and paraffinic oil is to be used, one may initially charge about 3,300 pounds of paraffinic oil and 1,000 pounds of 12-hydroxy stearic acid to reactor 10. This mixture may then be heated, saponified, milled, and then mixed with about 5,700 pounds of the paraffinic oil.

In general, from about 25 to about 50 weight percent of the total amount of paraffinic oil to be used is charged initially, and the remainder of such oil is charged in subsequent steps. In one embodiment, from about 35 to about 45 weight percent of the total amount of paraffinic oil to be used is charged initially.

The 12-hydroxy stearic acid and the initial amount of the paraffinic oil are preferably charged via lines 14 and 16, respectively. The reaction mixture thus formed is then heated in reactor 10 to a temperature of from about 170 to about 200 degrees Fahrenheit and, preferably, from about 175 to about 185 degrees Fahrenheit. Generally the materials are heated for at least about 30 minutes, and, preferably, for at least about 45 minutes. In one embodiment, the materials are heated for from about 45 to about 60 minutes.

The heating of the reaction mixture is preferably conducted under air, with agitation. It is preferred to stir the reaction mixture while heating at a rate of, e.g., from about 15 to about 30 revolutions per minute and, more preferably, about 25 revolutions per minute.

After the mixture has been heated for at least about 30 minutes, saponifying agent is added via lines 18 and/or 20. The saponifying agent used preferably comprises at least two different metal hydroxides, which, in the most preferred embodiment, are lithium hydroxide and calcium hydroxide. In one preferred embodiment, prior to the time the saponifying agent(s) is added, the heating of the mixture is stopped to allow the addition of the saponifying agent(s).

In general, a sufficient amount of saponifying agent is added via lines 18 and/or 20 to esterify the stearic acid. Although the exact stoichiometric amount of the metal hydroxide(s) may be used, from about 0.9 to about 1.1 times the stoichiometric amount (a "substantially stoichiometric amount") may also be used.

When both calcium hydroxide and lithium hydroxide are used, the calcium hydroxide may be added prior to the lithium hydroxide, the lithium hydroxide may be added prior to the calcium hydroxide, or both of these hydroxides may be added simultaneously.

When both calcium hydroxide and lithium hydroxide are used, it is preferred to add from about 0.5 to about 10 moles of lithium hydroxide per mole of calcium hydroxide. It is more preferred to add at least about 5.0 moles of lithium per mole of calcium hydroxide. It is even more preferred to add at least 10 moles of lithium hydroxide per mole of calcium hydroxide.

After the saponifying agent have been added to the reactor 10, the reaction mixture is again heated, preferably with agitation (such as stirring) to a temperature of from about 360 to about 450 degrees Fahrenheit until neutralization (saponification) has been completed. It is preferred to use a temperature of from about 380 to about 400 degrees Fahrenheit during this neutralization reaction. Samples of the mixture in reactor 10 may be periodically removed via line 22 to laboratory 24 to determine the extent to which the neutralization has been completed. The extent of neutralization may be determined by means of a conventional test such as, e.g., A.S.T.M. Standard Test D 974-87, "Test Method for Neutralization Number by Color Indicator Titration".

In one embodiment, the saponification reaction is conducted in reactor 10 for at least about 2 hours.

Once the reaction mixture is reactor 10 has been neutralized, saponification is completed. The saponified mixture may then comminuted. Thus, the reaction mixture may be passed via line 26 to mill 12, where the particle size of the mixture is reduced.

The function of the comminuter 12 is to reduce the particle size of the reaction mixture so that substantially all (at least about 90 weight percent) of the particles in the reaction mixture have a maximum dimension which smaller than about 1 micron; this step not only provides a smoother product, but it also provides a more stable product.

The milling is conducted while the reaction mixture is at a temperature of from about 360 to about 450 degrees Fahrenheit. Any means known to those skilled in the art for hot milling of petroleum products may be used.

By way of illustration and not limitation, comminuter 12 may be a knife blade mill comprised of rotating blades which consist essentially of surgical stainless steel.

Samples of the mixture being milled may periodically be removed from mill 12 via line 28 to laboratory 30, where the particle size distribution of the reaction mixture may be evaluated to determine whether substantially all of the particles in the mixture are smaller than about 1 micron. Any conventional means may be used to determine such particle size distribution. Thus, e.g., one may use a microscope. Thus, for example, one may use a scanning electron microscope.

Reaction mixture with the correct particle size is preferably recycled via line 32 to reactor 10. Alternatively, in another embodiment (not shown), such reaction mixture is passed to a separate reactor.

After the hot milling step, to the mixture with the correct particle size is added the remainder of the paraffinic oil. In the embodiment illustrated in FIG. 1, the remainder of such paraffinic oil is preferably added via line 34 to the hot reaction mixture while such mixture is being agitated and cooled. It is preferred that the addition of the remainder of the paraffinic oil be made while the reaction mixture is cooled from a temperature of between from about 360 to about 450 degrees Fahrenheit to a temperature of at least about 160 degrees Fahrenheit; such cooling generally occurs over a period of at least 12 hours.

It is preferred to add the remainder of this paraffinic oil is several different charges during the cooling step in order to facilitate such cooling. In one embodiment, at least two separate charges of the remainder of the paraffinic oil are made. In another embodiment, at least three separate charges of the remainder of such oil are made. In yet another embodiment, the remainder of such paraffinic oil is continuously added to the reaction mixture during the time the mixture is cooled to a temperature of at least about 160 degrees Fahrenheit.

It is preferred that, during the addition of the remainder of the paraffinic oil via line 34, the reaction mixture is agitated while it is cooled, such as by stirring. In one embodiment, the process is substantially continuous, with the comminution step, the recycle step, the addition of the additional paraffinic oil, and the cooling step, all being conducted substantially simultaneously.

During the charging of the additional paraffinic oil, samples of the diluted reaction mixture may be periodically withdrawn from reactor 10 via line 22 to line 24, where the worked penetration index of the mixture may be determined. As is known to those skilled in the art, the worked penetration of a lubricating grease is the penetration of a sample of lubricating grease after it has been heated to 77 degrees Fahrenheit and then subjected to 60 double strokes in a standard grease worker; see, e.g., A.S.T.M. Standard Test D 217-86, "Test Method for Cone Penetration of Lubricating Grease". The penetration of the grease is the depth, in tenths of a millimeter, that the cone penetrates the sample under the prescribed conditions of weight, time, and temperature.

As is known to those skilled in the art, the unworked penetration of the grease sample also may be measured. The unworked penetration is measured when a sample of grease is brought to 77 degrees Fahrenheit and transferred to a standard cup; its surface is smoothed and the cone, in its penetrometer assembly, placed so that its tip just touches the level grease surface. The cone and its movable assembly (weighing 150 grams) are permitted to rest on and drop into the grease for exactly five seconds; the distance dropped is measured (see page 3.03 of the aforementioned "Lubricating Grease Guide").

Because many greases change significantly in consistency when manipulated, the worked penetration is thus considered to be more significant as to serviced behavior than is unworked penetration. The greater the disparity between the unworked and worked penetration values, the less stable the grease is.

Referring again to FIG. 1, when the reaction mixture in reactor 10 has a worked penetration of from about 250 to about 280, a lubricating grease with the desired properties has been produced. This grease may then be discharged from reactor 10 via line 36.

In one preferred embodiment, and by way of illustration, a 10,000 pound batch of lubricating grease is prepared. To reactor 10 is charged 3,300 pounds of HF bright stock oil and 1,000 pounds of 12-hydroxy stearic acid with a saponification number of 200 and a neutralization number of 185. This mixture is heated at 180 degrees Fahrenheit for 45 minutes. Thereafter, to this mixture are added 230 pounds of powdered lithium hydroxide and 20 pounds of calcium hydroxide (via lines 18 and 20). Thereafter, the reaction mixture is heated at a temperature of 400 degrees Fahrenheit for 30 minutes, thereby saponifying it. The hot saponified mixture is then passed through a knife blade mill until all of the particles in it are smaller than 1 micron. To the comminuted mixture is then added 5,450 pounds of the HF bright stock oil, with stirring at 25 revolutions per minute, until the worked penetration of the lubricating grease is 275.

In one preferred embodiment, after the comminution step, from about 1 to about 5 weight percent of graphite is added to the reaction mixture. It is preferred to use graphite with a particle size distribution such that substantially 95 weight percent of the graphite particles are smaller than 325 mesh (44 microns).

The lubricating grease produced by the process of this invention preferably has a dropping point of at least 300 degrees Fahrenheit. The dropping point of the grease is that temperature at which the grease passes from a semi-solid to a liquid state. It may be determined in accordance with A.S.T.M. Standard Test D-2265-78 (1983), "Test Method for Dropping Point of Lubricating Grease Over Wide Temperature Range".

The lubricating grease produced by the process of this invention is substantially more compatible with elastomeric material than are comparable prior art lubricating greases. When the grease is tested in substantial accordance with Federal Standard 791T, Method 3603.5, it has less than a 40 percent increase in swell and a 35 percent increase in weight. When the tested is repeated at 200 degrees Fahrenheit, it has less than a 200 percent increase in swell and less than a 100 percent increase in weight.

When the grease of this invention is tested for oxidation resistance by A.S.T.M. Standard Test D 942-78 (1984), "Test Method for Oxidation Stability of Lubricating Grease by the Oxygen Bomb Method", it exhibits a drop of less than about 5 pounds per square inch in 100 hours.

When the lubricating grease of this invention is tested in accordance with the corrosion test specified by A.S.T.M. Standard Test D 1743-87, "Test Method for Corrosion Prevention Properties of Lubricating Greases", it passes such test.

The following examples are presented to illustrate the claimed invention but are not to be deemed limitative thereof. Unless otherwise specified, all parts are by weight and all temperatures are in degrees Fahrenheit.

EXAMPLE 1

In the experiment of this example, a 10,000 pound batch of lubricating grease was prepared.

To a Blaw-Knox, stainless steel, oil-jacketed chemical reactor equipped with an agitator, a recirculating pump, and a knife mill were charged 3,300 pounds of HF bright stock oil, which was obtained from the Penzoil Products Company of Penzoil Place, Houston, Tex.; the bright stock oil was pumped into the reactor over a period of ten minutes.

Thereafter, 1,000 pounds of 12-hydroxy stearic acid with a saponification number of 200 and a neutralization number of 185 were added to the reactor over a period of fifteen minutes. This stearic acid was purchased as product number 612-H from the Acme-Hardesty Company of P.O. Box 707, Jenkintown, Pa.

The reaction mixture was then heated to a temperature of 180 degrees Fahrenheit for 30 minutes while being stirred at 25 revolutions per minute.

230 pounds of lithium hydroxide monohydrate (which was obtained from the Cyprus Foote Mineral Company of 301 Lindenwood Drive, Malvern, Pa.) were mixed with 690 pounds of water. The aqueous solution thus formed was then charged to the reaction mixture over a period of five minutes, with stirring.

Thereafter, 20 pounds of powdered calcium hydroxide (which was obtained from the Centre Lime and Stone Company of Pleasant Gap, Pa.) were added to the reaction mixture over a period of five minutes, with stirring. Thereafter, the reaction mixture was heated at a temperature of 400 degrees Fahrenheit for 30 minutes, thereby saponifying it. The hot saponified mixture was then passed through a knife blade mill until at least 90 weight percent of the particles in it were smaller than 1 micron.

To the ground mixture were then added the remaining 5,450 pounds of the HF bright stock oil until the worked penetration of the lubricating grease was 275. This addition occurred over a period of 5 hours while the reaction mixture was stirred at 25 revolutions per minute; during this period, the temperature of the reaction mixture slowly decreased from 400 degrees Fahrenheit to 160 degrees Fahrenheit. Additionally during this period, 200 pounds of graphite were added to the reaction mixture over a period of fifteen minutes while the reaction mixture was continually stirred. The graphite used was purchased as product A99 from The Asbury Graphite Mills, Inc. of P.O. Box 144, Asbury, N.J.

A sample of the lubricating grease thus produced was tested in accordance with A.S.T.M. Standard Test D217-86 for penetration. It was found to have an unworked penetration of 275 and a worked penetration of 270.

The dropping point of the lubricating grease, as determined by A.S.T.M. Standard Test D2265-78 ("Test Method for Dropping Point of Lubricating Grease Over Wide Temperature Range"), was 380 degrees Fahrenheit.

The compatibility of the lubricating grease of this example with elastomeric material was determined in substantial accordance with Federal Standard 791C, Method 3603.5, but the test was modified to use to use standard, commercially available truck tire inner tube identified as "radial truck 9.00r20" and which was comprised of synthetic rubber. After being contacted with the lubrication grease of this example in accordance with the test, the inner tube samples had a volume change of less than 10 percent and a weight change of less than 5 percent. Comparative Example 2

The procedure of Example 1 was substantially followed, with the exception that the hot milling step was omitted and replaced with a milling step which occured after the addition of all of the lubricating oil. In the experiment of this Example, after the addition of the second batch of lubricating oil, the reaction mixture was milled until substantially all of its particles were smaller than 1 micron.

The lubricating grease obtained in the experiment of this Example had an unworked penetration of 275, but its worked penetration was 350.

COMPARATIVE EXAMPLE 3

The procedure of Example 1 was substantially followed with the exception that the HF bright stock oil was replaced with a white mineral oil. This white mineral oil was purchased from ICI Petroleum Specialties Inc. of 221 West Grand Avenue, Montvale, N.J. 07645 as product BRITOL 55T.

The test procedure of Example 1 was repeated to determine the compatibility of the lubricating grease of this Example with the elastomeric inner tube material. The samples of inner tube exhibited a volume change of 40 percent and a weight change of 20 percent.

COMPARATIVE EXAMPLE 4

The procedure of Example 1 was substantially followed with the exception that the HF bright stock oil was replaced with a 325 Solvent Neutral paraffinic neutral oil. This paraffinic neutral oil was purchased from Exxon Co. U.S.A. of Post Office Box 2180, Houston, Tex. 27252. as product number 1247.

The test procedure of Example 1 was repeated to determine the compatibility of the lubricating grease of this Example with the elastomeric inner tube material. The samples of inner tube exhibited a volume change of 45 percent and a weight change of 20 percent.

COMPARATIVE EXAMPLE 5

The procedure of Example 1 was substantially followed with the exception that the HF bright stock oil was replaced with a 100 LP Solvent Neutral paraffinic neutral oil. This paraffinic neutral oil was purchased from the aforementioned Exxon Company U.S.A. of Houston, Tex. as product number 1365.

The test procedure of Example 1 was repeated to determine the compatibility of the lubricating grease of this Example with the elastomeric inner tube material. The samples of inner tube exhibited a volume change of 70 percent and a weight change of 45 percent.

COMPARATIVE EXAMPLE 6

The procedure of Example 1 was substantially followed with the exception that the HF bright stock oil was replaced with a 325 paraffinic neutral oil. This paraffinic neutral oil was purchased from the Sun Oil Company of Ten Penn Center, Philadelphia, Pa. as product number HPO 325.

The test procedure of Example 1 was repeated to determine the compatibility of the lubricating grease of this Example with the elastomeric inner tube material. The samples of inner tube exhibited a volume change of 40 percent and a weight change of 20 percent.

COMPARATIVE EXAMPLE 7

The procedure of Example 1 was substantially followed with the exception that the HF bright stock oil was replaced with a 100 paraffinic neutral oil. This paraffinic neutral oil was purchased from the aforementioned Sun Oil Company as product number HPO 100.

The test procedure of Example 1 was repeated to determine the compatibility of the lubricating grease of this Example with the elastomeric inner tube material. The samples of inner tube exhibited a volume change of 70 percent and a weight change of 40 percent.

COMPARATIVE EXAMPLE 8

The procedure of Example 1 was substantially followed with the exception that the HF bright stock oil was replaced with a 580 paraffinic neutral oil. This paraffinic neutral oil was purchased from the Noco Energy Corporation of 700 Grand Island Blvd., Tonawanda, N.Y. as product 580 neutral.

The test procedure of Example 1 was repeated to determine the compatibility of the lubricating grease of this Example with the elastomeric inner tube material. The samples of inner tube exhibited a volume change of 40 percent and a weight change of 20 percent.

COMPARATIVE EXAMPLE 9

Twenty parts of polybutene were mixed with 80 parts of the HF bright stock oil used in Example 1. The polybutene was purchased from the Amoco Chemical Corporation of Chicago, Ill. as "INDAPOL 300".

The procedure of Example 1 was substantially followed with the exception that the HF bright stock oil was replaced with the mixture of polybutene and bright stock oil.

The test procedure of Example 1 was repeated to determine the compatibility of the lubricating grease of this Example with the elastomeric inner tube material. The samples of inner tube exhibited a volume change of 10 percent and a weight change of 5 percent.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A process for preparing a lubricating grease, comprising the steps of:

(a) mixing 12-hydroxy stearic acid and a first portion of paraffinic oil, wherein said first portion of said paraffinic oil has an aniline point of at least about 220 degrees Fahrenheit, a viscosity index of at least about 90, a Saybolt viscosity at 100 degrees Fahrenheit of from about 100 to about 3,000 Saybolt Universal seconds, a flash point of at least about 550 degrees Fahrenheit, and a pour point of from about 10 to about 35 degrees Fahrenheit, thereby providing a first mixture;

(b) heating said first mixture to a temperature of from about 170 to about 200 degrees Fahrenheit for at least about 30 minutes, thereby providing a first heated mixture;

(c) adding lithium hydroxide saponifying agent and calcium hydroxide saponifying agent to said mixture in an amount sufficient to neutralize said 12-hydroxy stearic acid, thereby forming a second mixture, wherein:

1. from about 0.9 to about 1.1 times the theoretical amount of the stoichiometric amount of saponifying agent required to completely neutralize said 12-hydroxy stearic acid is added to said mixture in the form of said lithium hydroxide and said calcium hydroxide, and
2. from about 0.5 to about 10 moles of said lithium hydroxide are added for each mole of said calcium hydroxide added;

(d) heating said second mixture at a temperature of from about 360 to about 450 degrees Fahrenheit, thereby providing a neutralized second mixture;

(e) comminuting said neutralized second mixture until at least about 90 weight percent of the particles in said neutralized second mixture are smaller than 1 micron, thereby providing a comminuted second mixture, wherein said second neutralized mixture is comminuted while it is at a temperature of from about 160 to about 450 degrees Fahrenheit; and (f) mixing said second comminuted mixture with a second portion of said paraffinic oil, wherein:

1. said second portion of said paraffinic oil has an aniline point of at least about 220 degrees Fahrenheit, a viscosity index of at least about 90, a Saybolt viscosity at 100 degrees Fahrenheit of from about 100 to about 3,000 Saybolt Universal seconds, a flash point of at least about 550 degrees Fahrenheit, and a pour point of from about 10 to about 35 degrees Fahrenheit,
2. the total weight of said first portion of said paraffinic oil and said second portion of said paraffinic oil is from about 65 to about 75 percent (by weight) of the total weight of said first portion of said paraffinic oil, said second portion of paraffinic oil, and said 12-hydroxy stearic acid, and
3. the weight of said first portion of said paraffinic oil is from about 25 to about 50 percent (by weight) of the total weight of said first portion of paraffinic oil and said second portion of paraffinic oil.

2. The process as recited in claim 1, wherein at least about 5.0 moles of said lithium hydroxide are added to said reaction mixture for each mole of calcium hydroxide added to said reaction mixture.

3. The process as recited in claim 2, wherein said first portion of paraffinic oil has a Saybolt viscosity at 100 degrees Fahrenheit of from about 1,500 to about 3,000 Saybolt Universal Seconds.

4. The process as recited in claim 3, wherein said second portion of paraffinic oil has a Saybolt viscosity at 100 degrees Fahrenheit of from about 1,500 to about 3,000 Saybolt Universal Seconds.

5. The process as recited in claim 4, wherein said second mixture is heated at a temperature of from about 380 to about 400 degrees Fahrenheit for at least about 1 hour.

6. The process as recited in claim 5, wherein said first mixture is heated at a temperature of from about 175 to about 185 degrees Fahrenheit for at least about 30 minutes.

7. The process as recited in claim 6, wherein said first mixture is stirred at a rate of from about 15 to about 30 revolutions per minute while it is being heated.

8. The process as recited in claim 7, wherein said second mixture is stirred at a rate of from about 15 to about 30 revolutions per minute while it is being heated.

9. The process as recited in claim 8, wherein said comminuted second mixture is stirred at a rate of from about 15 to about 30 revolutions per minute while it is mixed with said second portion of said paraffinic oil.

10. The process as recited in claim 9, wherein a portion of said comminuted second mixture is added to said first mixture.

* * * * *